United States Patent [19]

Riedel

[11] Patent Number: 4,912,792

[45] Date of Patent: Apr. 3, 1990

[54] CONTINUOUS FINISH TREATMENT FOR WOOLEN FABRICS

[75] Inventor: Dieter Riedel, Porta Westfalica, Fed. Rep. of Germany

[73] Assignee: Johannes Menschner Maschinenfabrik GmbH & Co. KG, Kampweg, Fed. Rep. of Germany

[21] Appl. No.: 212,903

[22] Filed: Jun. 29, 1988

Related U.S. Application Data

[63] Continuation-in-part of Ser. No. 927,388, Nov. 6, 1986.

[30] Foreign Application Priority Data

Nov. 9, 1985 [DE] Fed. Rep. of Germany ..... 3539792

[51] Int. Cl.[4] ..... D06M 13/16

[52] U.S. Cl. ..... 8/128.1; 8/127.5

[58] Field of Search ..... 8/128.1, 139.1, 127.5

[56] References Cited

FOREIGN PATENT DOCUMENTS 1070694 1/1967 United Kingdom .
1070695 1/1967 United Kingdom .

*Primary Examiner*—A. Lionel Clingman
*Assistant Examiner*—John F. McNally
*Attorney, Agent, or Firm*—Penrose Lucas Albright

[57] ABSTRACT

A fabric such as a knitted wool or wool mixture is treated by the application of a crabbing agent together with a hygroscopic substance. The fabric is then dried, sheared and moistened before passing through a decatizing apparatus in which the crabbing agent, reactivated during the moistening stage, reacts within the fabric fibers to render the changes produced during decatizing permanent.

11 Claims, 1 Drawing Sheet

CONTINUOUS FINISH TREATMENT FOR WOOLEN FABRICS

This application is a continuation-in-part of application Ser. No. 927,388, filed Nov. 6, 1986, now abandoned.

BACKGROUND OF THE INVENTION

1. Technical Field

The present invention relates to a method for the continuous treatment of textile fabrics including decatizing and crabbing or setting of the fabric. The invention is particularly applicable to wool and wool mixture fabrics, for example knitted fabrics.

2. Prior Art

Various methods for treating fabric with a chemical crabbing agent are known. In such methods the chemical agent is applied to the fabric which is then passed through a drying stage and, if required by the nature of the fabric, a shearing stage, before setting takes place in the pressing or decatizing stage. In this type of process, the desired chemical reaction setting effect to be produced by the crabbing agent may be lost because of evaporation or volatilization of the crabbing agent in the drying stage.

SUMMARY OF THE INVENTION

An object of the present invention is to improve this type of fabric treatment method so that the effect of the crabbing agent is fully preserved despite the moisture removal that takes place during a preceding drying stage.

In accordance with the present invention, a hygroscopic substance is added to the crabbing or setting agent which is applied to the fabric before the drying and shearing stages. Moreover, the fabric is subjected to a moistening step immediately before being subjected to the pressure and heat treatment of a decatizing apparatus.

The moistening step prior to decatizing replaces sufficient of the moisture removed as a consequence of the drying stage in order to reactivate the crabbing agent. This ensures that the crabbing agent is fully effective to produce the desired result in the decatizing apparatus. The presence of the hygroscopic substance enables moisture to be retained during the drying stage and also facilitates the moistening stage.

Obviously the hygroscopic substance must be one which will not damage the fabric. Particularly suitable hygroscopic substances for use in the method of the invention are reaction agents, for example in the form of salts, which embed themselves in the mass of wool fibers and absorb moisture by encapsulation. Suitable hygroscopic substances which are known for use in treatment of textiles include ethylene glycol and urethane glycol, and other suitable hygroscopic substances include benzyl alcohol and dodecylpyridinium chloride. The hygroscopic substance is preferably applied to the fabric with the crabbing agent in solution, and may be present in an amount up to 25 g/l As the crabbing agent, the method of the invention may employ any one of a large number of reducing agents which are well known for use as crabbing or setting agents in the treatment of textile fabrics. For example, the crabbing agent may be selected from a lower alkanolamine sulfite, a metallic formaldehyde sulfoxylate, an alkali metal borohydride, an alkali metal sulfide, a mercaptan such as hydrogen sulfide or sodium or potassium hydrosulfide, sodium hydrosulfite, and many others.

The moistening stage is preferably carried out with the aid of a rotor moisturing apparatus. In such an apparatus a rotor is driven at high speeds to apply water in the form of a spray fan. Such a spray may have the fineness of a brush stroke when it impinges on the material.

The crabbing agent, after activation in the moistening stage, reacts within the fibers of the fabric as the fabric passes through the decatizing and setting apparatus which subjects the fabric to a heat and pressure treatment. Best results are obtained when the fabric is fed through the apparatus under an impermeable heatable pressure band while being subjected to high longitudinal tension. This results in a particularly intensive shape modification in the treated fabric. A suitable decatizing apparatus is described in Fed. Rep. German Patent Specification No. 2 727 514 and U.S. Pat. No. 4,102,643.

The use of the crabbing agent ensures that the decatizing effect is permanent. However, the actual resulting changes in the fabric depend on the nature of the decatizing apparatus, the temperature and pressure conditions employed and the time of treatment. These factors determine the resulting alteration in thickness, feel, gloss and volume of the fabric after decatizing. The crabbing agent ensures that these alterations are maintained permanently. It is therefore possible to use the method of the present invention with any known decatizing apparatus and produce the results which are normally characteristic of such apparatus with enhanced permanence. Therefore if a FINISH decatizing machine is employed, the expected FINISH decatizing effects are obtained permanently. If the decatizing apparatus described in the above referenced Patent specifications is employed together with the method of the present invention, even more permanent effects are obtained which are comparable with those of classical kier-decatizing.

Preferably the fabric is cooled after passage through the decatizing apparatus.

It is particularly easy to implement the method of the present invention since it requires no special equipment. The mixture of the crabbing agent and hygroscopic substance can be applied using any foulard machine. Such machines are generally available in fabric finishing works. It is also necessary to provide apparatus for carrying out the moistening stage. It will be noted that since the apparatus for carrying out the moistening stage only requires to spray water, problems normally encountered when spraying chemicals are not present. The decatizing apparatus is of conventional design and need not be modified for use in the present invention.

The fabric finishing method in accordance with the present invention will now be described in more detail.

DESCRIPTION OF PREFERRED EMBODIMENTS

Figure 1:
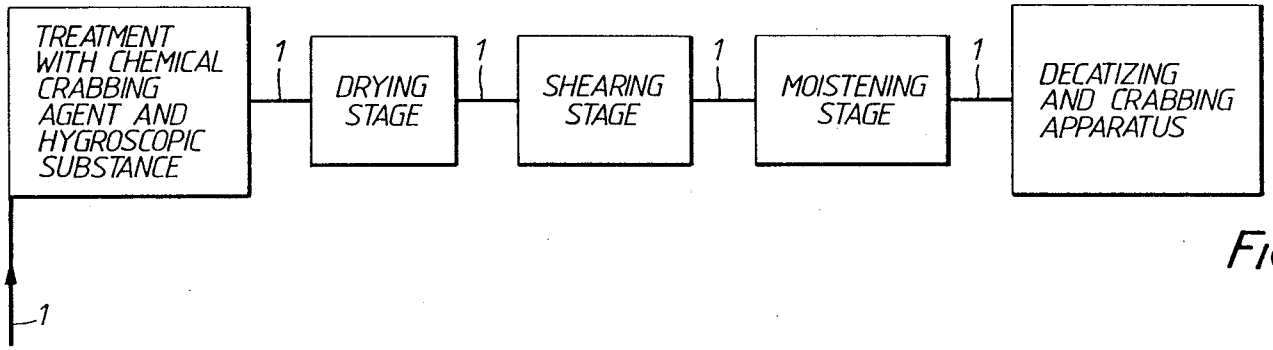
FIG. 1 is a block diagram illustrating the steps in carrying out the method of the present invention.

FIG. 1 shows diagrammatially the various stages through which a length of fabric 1 is passed in a continuous manner. The fabric may be a wool or wool mixture fabric, particularly a knit fabric.

The first stage is treatment of the fabric with a chemical crabbing agent to which one or more suitable hygroscopic substances has been added. The chemical crabbing agent and the hygroscopic substance are preferably applied in an aqueous solution using, for example, a foulard machine, and may be applied to the fabric either wet or dry. In the latter case, the application should preferably be such as to produce liquid absorption of about 60 to 70% by weight. The solution may include other agents such as a fabric softener and/or a permanent gloss forming agent, and is preferably applied at a temperature of about 50° to 80° C. In a particular example, the solution contains about 30 to 40 grams per liter of silicone as a fabric softener, about 20 to 40 grams per liter of paraffin for permanent gloss formation, about 5 grams per liter of sodium hydrosulfite ($N_aHSO_3$) as the crabbing agent, and about 2 grams per liter of benzyl alcohol as the hygroscopic substance. In an alternative example the hygroscopic substance is $1.5\times10^{-2}$ mol per liter of dodecylpyridinium chloride.

After application of the crabbing agent and hygroscopic substance, the fabric passes through a drying stage and, if required, a shearing stage. The fabric is then passed through a moistening stage in which water is sprayed onto the fabric to reactivate the crabbing agent, the spraying preferably bringing the moisture content of the fabric to about 20 to 30% by weight.

The fabric then passes through a decatizing and crabbing apparatus in which the fabric is subjected to pressure and heat treatment under moist conditions to effect the desired pressing and setting of the fabric. Subsequent cooling of the treated fabric serves to enhance the fixing of the pressed and set fabric.

Figure 2:
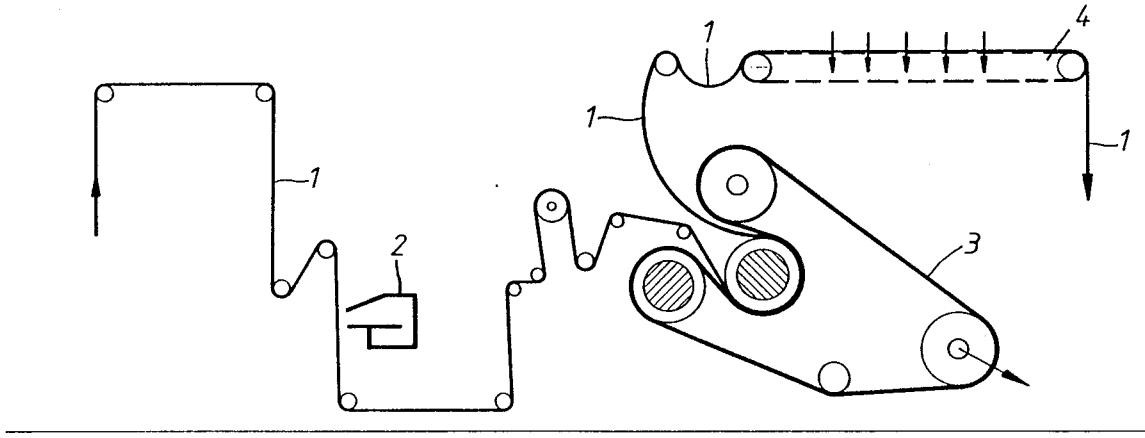
FIG. 2 is a diagrammatic representation of part of the apparatus required for carrying out the method of the present invention.

FIG. 2 diagrammatically shows apparatus for carrying out the described method. Fabric, to which the chemical crabbing agent and hygroscopic substance have been applied and which has been subsequently dried and sheared, is directed past a moistening device 2 which is designed to ensure drip-free moistening of the fabric. The device is preferably a rotor spraying device which applies a spray fan of finely divided droplets onto the surface of the fabric. This fine spray of moisture reactivates the crabbing agent. The fabric is then passed through a decatizing apparatus 3 such as described for example in Fed. Rep. German Patent Specification No. 2 727 515. Since this apparatus is not modified for use in the present method, it is not necessary to describe it in detail. Essentially the fabric to be treated is passed round a heated roller underneath a pressure belt which may be heated in order to subject the fabric to a controlled heat and pressure treatment. In a particular example the roller temperature is about 135° C., the pressure exerted by the belt is from 2.0 to 6.0 kilograms per square centimeter and the rate of travel of the fabric is from 12 to 16 meters per minute with the moistening device being operated at a pressure of from 0.4 to 1.2 bar. However, as will be appreciated, the levels of pressure and temperature set within the decatizing apparatus and the duration of the treatment may be varied according to the actual effects to be achieved. The use of a crabbing agent ensures that these effects are permanent.

After passage through the decatizing and crabbing apparatus, the fabric 1 is fed out through a cooling device 4 in which high speed air jets are directed through the material as it is supported on a perforate conveyer belt. The effect of the cooling process is most pronounced when the fabric comes in close contact with the oxygen of the cooling air.

I claim:

1. A method for the continuous treatment of a wool or wool mixture fabric in which the fabric is subjected to a full permanent decatizing and fixing operation in a decatizing apparatus, including the steps of applying to said fabric upstream of said decatizing apparatus a liquid containing a crabbing or setting agent together with at least one hygroscopic substance which will not damage the fabric, said hygroscopic substance comprising a reaction agent capable of absorbing water by encapsulation, drying the fabric after the application of said liquid, and applying water to the dried fabric immediately prior to passage of said fabric through said decatizing apparatus for said full permanent decatizing and fixing operation, said application of water restoring the fabric to a moisture content of about 20 to 30% by weight in order to activate the crabbing agent and ensure that said crabbing agent is fully effective in said decatizing and fixing operation.

2. A method according to claim 1, wherein the crabbing or setting agent is sodium hydrosulfite.

3. A method according to claim 1, wherein the hygroscopic substance is selected from ethylene glycol, urethane glycol, benzyl alcohol, and dodecylpyridinium chloride.

4. A method according to claim 1, wherein the crabbing or setting agent and the hygroscopic substance are applied to the fabric in an aqueous solution.

5. A method according to claim 4, wherein the solution is applied to the fabric at a temperature of from 50° to 80° C.

6. A method according to claim 4, wherein the solution contains up to 25 g/l of the hygroscopic substance.

7. A method according to claim 4, wherein the solution contains benzyl alcohol as the hygroscopic substance in an amount of about 2 g/l.

8. A method according to claim 4, wherein the solution contains dodecylpyridinium chloride as the hygroscopic substance in an amount of $1.5\times10^{-2}$ mol/l.

9. A method according to claim 4, wherein the solution contains sodium hydrosulfite as the crabbing or setting agent in an amount of about 5 g/l.

10. A method according to claim 1, further including the step of cooling the fabric after passage through the decatizing apparatus.

11. A method according to claim 1, wherein the fabric is sheared after drying and before moistening.

* * * * *